US005381559A

United States Patent [19]

Wakefield, III

[11] Patent Number: 5,381,559

[45] Date of Patent: Jan. 17, 1995

[54] BANDANA WITH FLEXIBLE BILL

[76] Inventor: Franklin W. Wakefield, III, P.O. Box 1044, Morro Bay, Calif. 93443

[21] Appl. No.: 91,208

[22] Filed: Jul. 14, 1993

[51] Int. Cl.[6] ..... A42B 1/06

[52] U.S. Cl. ..... 2/207; 2/172; 2/195.1

[58] Field of Search ..... 2/171, 172, 175.1, 175.9, 2/195.1, 195.7, 207, 247

[56] References Cited

U.S. PATENT DOCUMENTS 1,144,366 6/1915 Levine ..... 2/195.1
1,190,427 7/1916 Kromer ..... 2/195.1
2,005,361 6/1935 Rollins et al. ..... 2/195.1
2,859,448 11/1958 Gaichel ..... 2/195.1
4,451,935 6/1984 Henschel ..... 2/247
5,121,507 6/1992 Brown ..... 2/172
5,253,369 10/1993 Patterson ..... 2/200.1

*Primary Examiner*—Clifford D. Crowder
*Assistant Examiner*—Diana L. Biefeld
*Attorney, Agent, or Firm*—John P. Halvonik

[57] ABSTRACT

The invention is a bandana with a flexible bill made of an inner layer of relatively rigid material. The bill has a series of stitching lines running parallel across the width of the bill which may be folded into varying positions for the user's convenience. The stitching lines offer convenient folding lines for this purpose. An optional pocket may be constructed at the rear of the bandana for secreting items, etc.

7 Claims, 2 Drawing Sheets

BANDANA WITH FLEXIBLE BILL

BACKGROUND AND PRIOR ART

The invention relates to the field of bandanas and other cloth coverings that go over the head. More particularly, the invention is a cloth bandana that has a flexible bill extended from it.

Bandanas are commonly known as cloth coverings which are often secured around the user's head or neck in order to minimize the effects of the sun, catch the sweat, etc. Most such coverings are of square construction which can be folded into a triangle for attachment around the head or neck by tying two ends of the cloth to one another at the back of the user's head or around the front of the user's neck.

The applicant's invention set forth below modifies the standard bandana constructions by being constructed in a generally triangular shape and by the addition of a relatively stiff, yet flexible, bill portion which is attached to the front of the bandana and extends out from the bandana. There are no prior art bandanas known to the inventor that have such a flexible bill portion.

SUMMARY OF THE INVENTION

The invention is a bandana with a flexible bill portion. The bill is preferably of three layer construction with an inner layer of relatively rigid material e.g. polyester felt and outer layers of cloth material. The bill should be of generally crescent shape with a series of stitching lines running parallel across the width of the bill. The polyester may then be folded into varying positions for the user's convenience. The stitching lines offer convenient folding lines for this purpose. An optional pocket may be constructed at the rear of the bandana for secreting items, etc.

It is an object of the invention to provide a flexible bill portion for a bandana which may be worn up or down to provide for different wearing options.

Another objective of the invention is to provide a bandana with bill made of absorbable material for absorbing perspiration.

Another objective is to provide a bill that may extended or retracted from the user's forehead as the user desires.

Another objective is to provide a bandana having an additional layer of polyester material which may function as a stiffening layers for a flexible bill.

Another objective is to provide a bandana which may find use as an air filter using layers of cotton and polyester.

Other objectives will become known to those skilled in the art once the invention is shown and described.

DESCRIPTION OF THE PREFERRED EMBODIMENT

Figure 1:
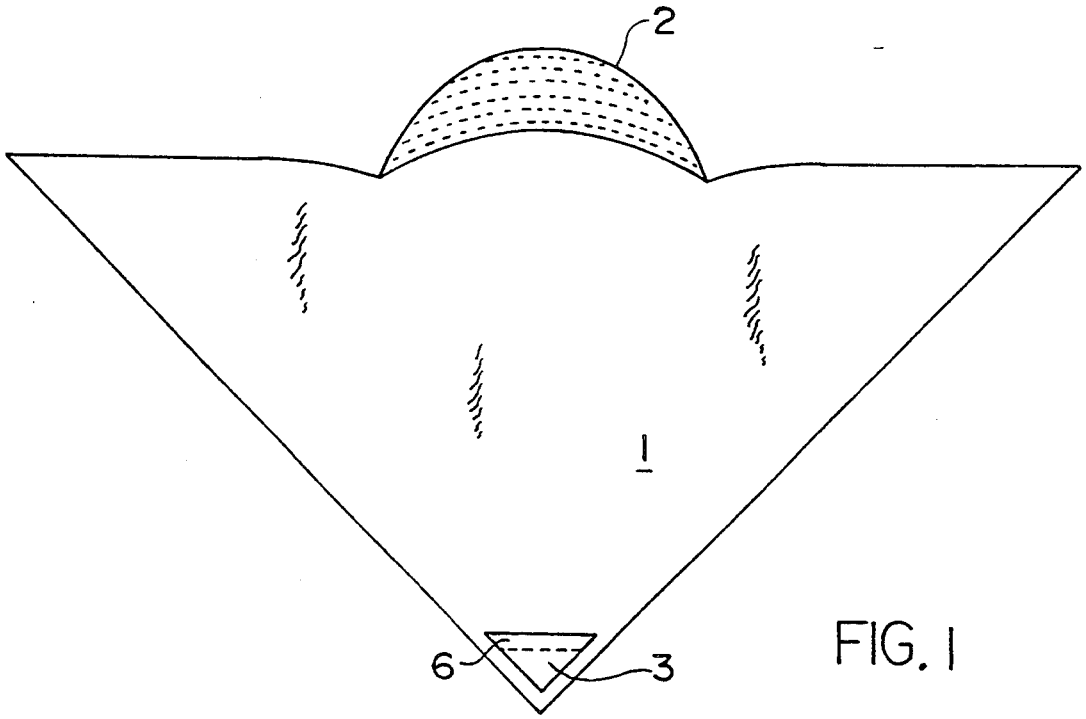
FIG. 1 Overall construction of the bandana.
Figure 2:
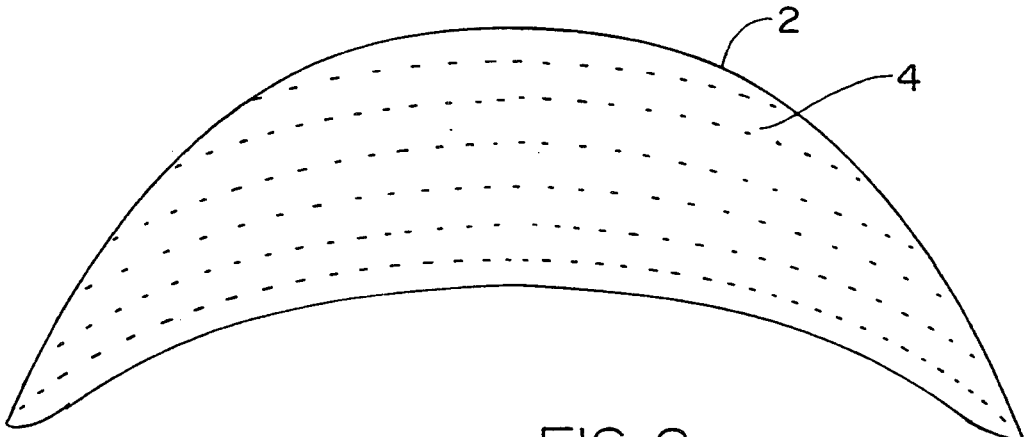
FIG. 2 Detail of bill.

The invention is shown in FIG. 1. The main portion is a generally triangular piece 1 of material, preferably of cloth material, such as cotton, and having three edges. The bill portion 2 is preferably made of a pressed polyester felt material (the inner layer) sandwiched inside of two cloth outer layers. Other materials are possible for the bill provided that they are flexible and of somewhat stiff construction.

The cloth in the bill may be the same material that the bandana is made of and, in fact, the cloth layers could be made as an extension of the main triangular portion. Two such cloth layers, one on the upper surface and one on the lower surface of the felt portion, complete the construction of the bill.-The bill portion is connected to one of the edges of the triangular shaped bandana.

The bill should be of substantially crescent shape, similar to a quarter moon shape, see FIG. 1. The attachment of the bill to the main portion may be by stitching or other means. It may also be made of one piece construction as noted above with the cloth layers of the bill serving as an extension of the main portion (the inner layer would, more than likely, be a separate piece).

Lines of stitching 4 are then placed through the three layers of the bill in parallel fashion as shown. These lines of stitching provide fold lines along which the bill may be folded up or down as the user desires. The line of connection between the bill and cloth may designated the "connecting line" and the lines of stitching should be about parallel to this line. There should be, at least, three lines of stitching and, at most, probably 10 lines of stitching. More lines would probably not be necessary given the purpose of the bill.

The bill may be sewn or otherwise attached to one side of the triangle. The preferred embodiment would have the bill attached to near the middle of one side although other arrangements are possible. The material comprising the inner layer of the bill should give it a rather stiff quality that allows it to be placed in different orientations and remain in such a position. This inner layer also provides for absorbent properties which may find use in absorbing perspiration.

As stated previously, it is believed that polyester felt material is the preferred material for the inner layer of the bill. The bill may also be partially folded under the main portion when it is folded in the hedadband style. This will minimize the amount of the bill that extends away from the forehead.

Figure 3:
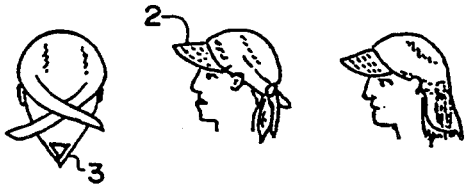
FIG. 3 Normal wearing method.
Figure 4:
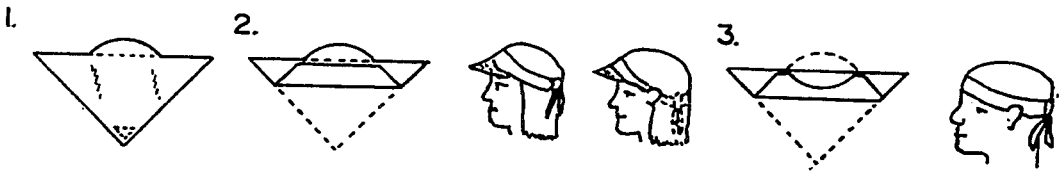
FIG. 4 Method of wearing as a head band.
Figure 5:
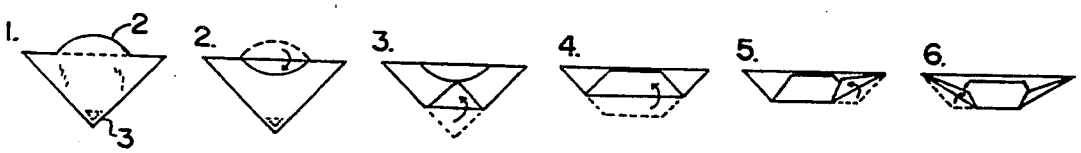
FIG. 5 Money belt style to be worn about the waist.
Figure 6:
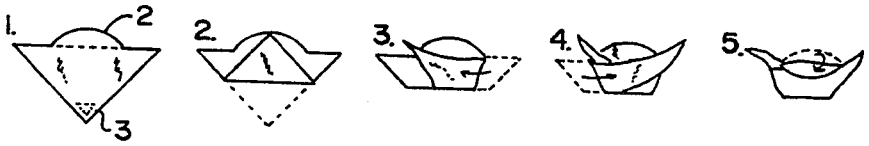
FIG. 6 Marsupial pouch style to be tied through belt loops.

The bandana in standard use would be folded and worn on the head as shown in FIG. 3 with two points of the triangle folded at the back of the head and tied together there. In the second method of wearing, shown in FIG. 4, the triangle is first folded into a rather straight shape and then placed around the head and tied in a similar fashion. This style resembles a head band with a visor projecting from the forehead. In FIGS. 5 and 6 optional arrangements are shown for wearing around the belt or the waist.

The bill may be extended upward or downward to ward off the rays of the sun. The bill may also be folded back toward the forehead so that it's length is minimized. The nature of the inner layer material helps retain this shape for such a time until the bill is again manipulated.

The secret pocket may formed at one point of the triangle by attaching a piece of material 3 across the point to form a pocket between this layer and the main cloth layer. A third material portion 6 is joined to the main layer above the second layer to form a closure. A VELCRO material strip may be attached to the second and third layers so that they may joined together to close the pocket.

It is possible to vary the size and proportions of the sides of the bandana without varying from the spirit of the invention. While a triangular construction is preferred ether shapes e.g. a square are possible. It is thought that cloth material, such as cotton, would make for the best bandana, however, other materials are possible without varying from the spirit of the invention.

I claim:

1. A bandana comprising: a main portion of cloth material, a bill in connection with said main portion comprising an inner layer of flexible material and two outer layers of cloth material, said inner layer having a top surface and an under surface, one of said outer layers in connection with said top surface of said inner layer and the other of said outer layers in connection with said under surface of said inner layer, said bill joined to said main portion along a connecting line, said bill having at least three lines of stitching running across said bill and parallel to said connecting line, said stitching connecting said inner layer with said outer layers so that said bill may be folded in increments along said lines of stitching.

2. The apparatus of claim 1 wherein said main portion is of triangular shape and said bill is of crescent shape.

3. The apparatus of claim 2 wherein said cloth material is cotton and said flexible material is polyester felt.

4. The apparatus of claim 1 having a pocket, said main portion having a triangular shape so as to have three side edges and three points, said pocket comprising a second material portion in connection with said main portion at two of said side edges and one of said points, so as to form a pocket between said second material portion and said main portion at one of said points, a third material portion in connection with said main portion and in such position so that a part of said third material portion overlies a part of said second material portion, said second and third material portions having a means for joining said second and third material portions to one another so as to close said pocket.

5. The apparatus of claim 4 where said closure means comprises corresponding portions of hook and loop material that may be joined to one another.

6. The apparatus of claim 1 having a pocket, said main portion having a rectangular shape so as to have four side edges and four points, said pocket comprising a second material portion in connection with said main portion at two of said side edges and one of said points, so as to form a pocket between said second material portion and said main portion at one of said points, a third material portion in connection with said main portion and in such position so that a part of said third material portion overlies a part of said second material portion, said second and third material portions having a means for joining said second and third material portions to one another so as to close said pocket.

7. The apparatus of claim 6 where said closure means comprises corresponding portions of hook and loop material that may be joined to one another.

* * * * *